US008256056B2

(12) United States Patent
Jones

(10) Patent No.: US 8,256,056 B2
(45) Date of Patent: Sep. 4, 2012

(54) ROTATABLE SCRUB BRUSH

(76) Inventor: Grant Jones, Carlsbad, CA (US)

( * ) Notice: Subject to any disclaimer, the term of this patent is extended or adjusted under 35 U.S.C. 154(b) by 916 days.

(21) Appl. No.: 12/082,657

(22) Filed: Apr. 14, 2008

(65) Prior Publication Data

US 2009/0255071 A1 Oct. 15, 2009

(51) Int. Cl.
*A46B 13/04* (2006.01)

(52) U.S. Cl. ..... 15/24; 15/29

(58) Field of Classification Search ..... 15/24, 29; 401/9, 11, 289

See application file for complete search history.

(56) References Cited

U.S. PATENT DOCUMENTS 1,381,221 A * 6/1921 Oves ..... 15/24
2,632,191 A * 3/1953 Grafani et al. ..... 15/22.1
3,500,490 A * 3/1970 Teren ..... 15/97.1
3,605,154 A * 9/1971 Dawkins ..... 15/24
4,177,532 A * 12/1979 Azuma ..... 15/24
6,170,107 B1 * 1/2001 George et al. ..... 15/24
7,114,211 B2 * 10/2006 Elster ..... 15/24
7,484,260 B2 * 2/2009 Jaffe ..... 15/24

* cited by examiner

*Primary Examiner* — Mark Spisich
*Assistant Examiner* — Michael Jennings
(74) *Attorney, Agent, or Firm* — Morland C. Fischer

(57) ABSTRACT

A rotatable scrub brush having particular application for removing dried residue from a bucket or similar container. The scrub brush includes a shaft, one end of which can be coupled to a conventional drill. The opposite end of the shaft is connected to a hollow bulb having cleaning bristles projecting outwardly therefrom. Openings through the bottom of the hollow bulb communicate with respective water inlet ducts. When the bulb is dipped in water standing in the bucket to be cleaned, the water will flow upwardly through the inlet ducts to be collected inside the bulb. A rotational force generated by the drill is imparted to the bulb by way of the shaft to cause the bulb to spin at high speed. As the spinning bulb is lifted out of the standing water and moved along the sides of the bucket, the water collected at the interior of the bulb will be expelled therefrom through outlet ports in order to moisten the cleaning bristles and the residue on the bucket to be removed by the bristles.

14 Claims, 6 Drawing Sheets

ROTATABLE SCRUB BRUSH

BACKGROUND OF THE INVENTION

1. Field of the Invention

This invention relates to a rotatable scrub brush having a hollow bulb and bristles projecting from the bulb for cleaning the sides, bottom, and corners of a bucket, or the like, that is covered with an adhesive residue. When the bulb is rotated, water collected at the hollow interior thereof is ejected under pressure for moistening the bristles and softening the residue to be removed from the bucket.

2. Background

Masons, tile layers, and other construction workers often use buckets to mix compounds such as tile adhesives, mortar, cement, drywall compound, stucco, paint, etc. These compounds are often quick drying, stick to the insides of the buckets, and are difficult to clean. Removing the compounds from the buckets is typically a laborious and time-consuming process often involving scrubbing the buckets by hand after several inches of water have been added. Workers sometimes use scrubbers, sponges, hand shovels, scrapers, and similar tools to try to scrape or scrub the buckets clean. In many cases, the water will splash out of the bucket which creates a messy work surface. In other cases, the worker cannot adequately remove the residue which results in the bucket being discarded.

It would be desirable therefore to have a scrubbing tool capable of easily and reliably cleaning the inside of a bucket or similar container in a relatively short time with only a minimum amount of water.

SUMMARY OF THE INVENTION

In general terms, a rotatable scrub brush is disclosed that is capable of removing dried residue from a bucket or similar container of the kind that is often filled with an adhesive mixture and used by masons, tile layers, construction workers, and the like. The scrub brush includes a shaft, one end of which is adapted to be coupled to a conventional drill. The opposite end of the shaft is coupled to a hollow bulb. Stiff (e.g., nylon) bristles project outwardly from the sides, bottom and corners of the bulb for reaching and cleaning the sides, bottom and corners of the bucket. Openings are formed through the bottom of the bulb. A plurality of water inlet ducts extend upwardly from respective ones of the openings at the bottom of the bulb to a location within the hollow interior of the bulb. A plurality of water entrance openings are formed through the top of the bulb to communicate with the hollow interior. Water outlet ports (e.g., holes) are distributed around the hollow bulb to communicate with the hollow interior thereof.

When the bulb of the scrub brush is dipped in standing water located inside the bucket to be cleaned, water will enter and be collected within the hollow interior of the bulb at a level lying below the tops of the water inlet ducts. For a small volume of water standing in the bucket, the water will enter the bulb by way of the openings through the bottom and the water inlet ducts extending upwardly from the openings. If the bulb is submerged in the standing water, then water will also enter the bulb by way of the water entrance openings formed through the top of the bulb. As the hollow bulb is lifted out of the standing water in the bucket, a rotational force applied by the drill is imparted to the bulb via the shaft so as to cause the bulb to spin at high speed. Accordingly, the centrifugal force generated as the spinning bulb moves along the sides of the bucket causes the water collected therein to be expelled under pressure through the outlet ports so as to advantageously moisten the bristles as well as soften the residue to be cleaned off the bucket by means of the bristles.

DETAILED DESCRIPTION OF THE PREFERRED EMBODIMENT

Figure 1:
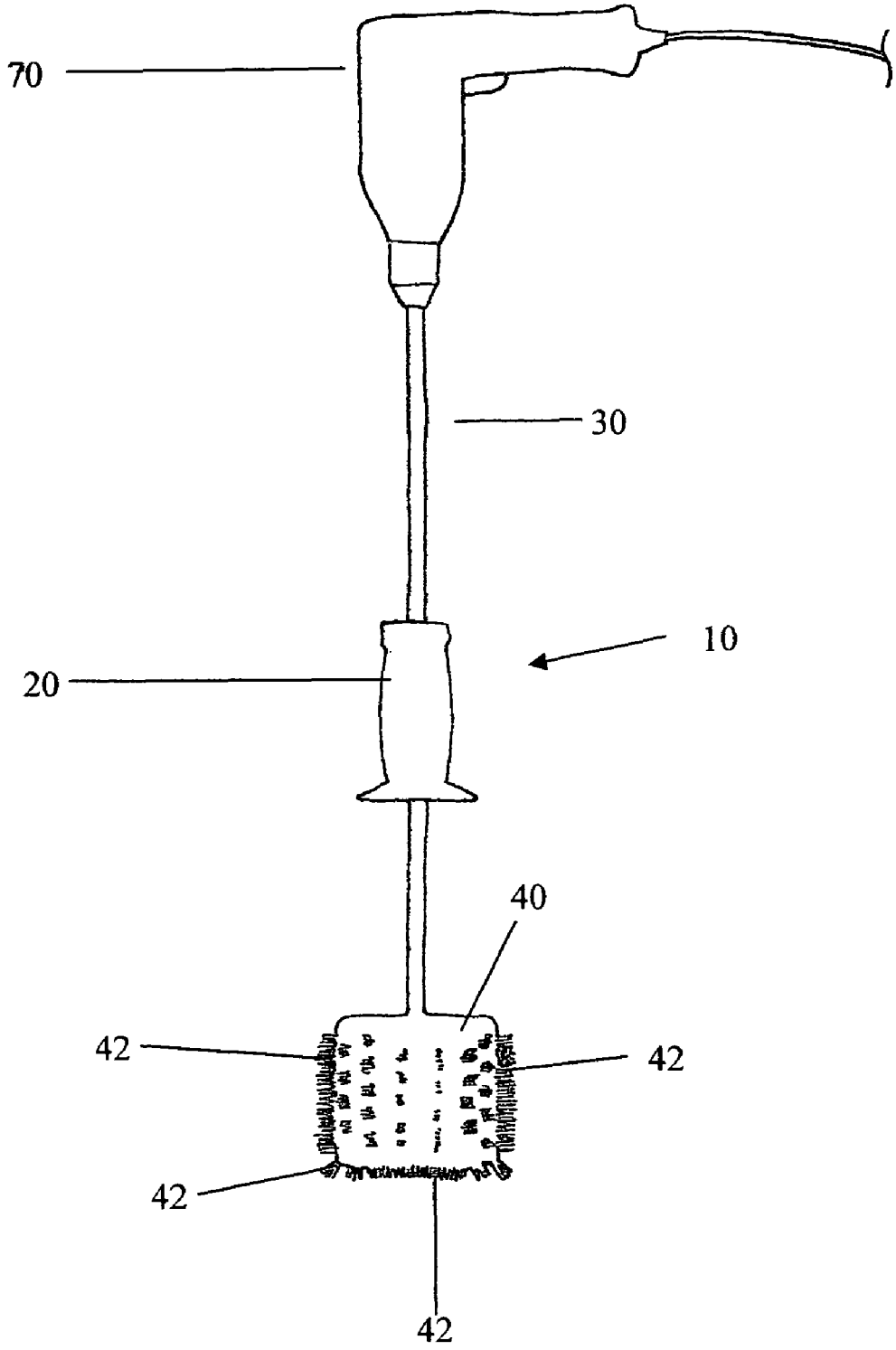
FIG. 1 shows a rotatable scrub brush according to a preferred embodiment of this invention coupled to a conventional drill.
Figure 2:
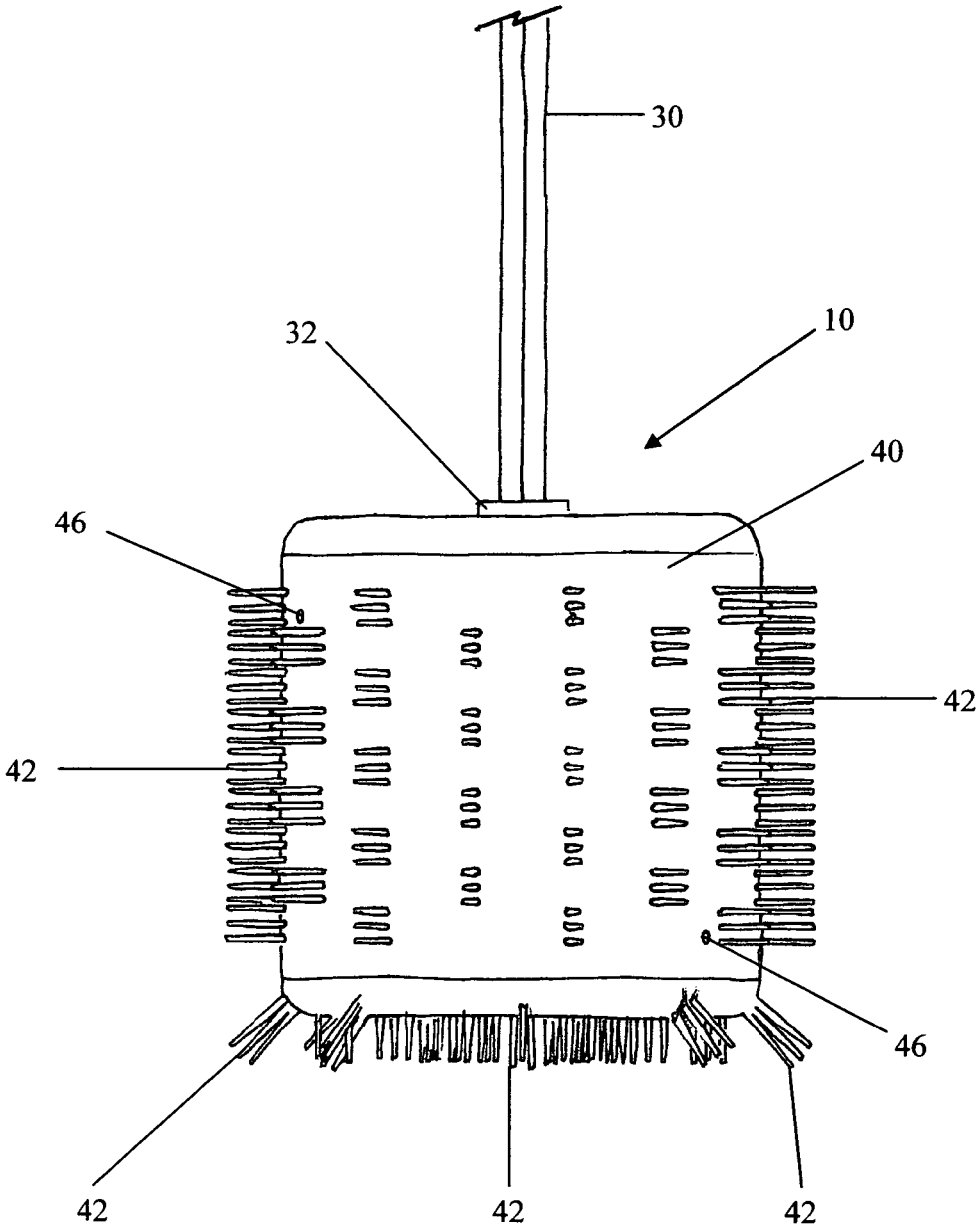
FIG. 2 is a side view of a hollow water collecting bulb of the scrub brush of FIG. 1.

A rotatable scrub brush 10 according to a preferred embodiment of this invention is now described in detail while referring to the drawings. Referring initially to FIGS. 1 and 2, the scrub brush 10 is shown having an outer handle 20 and an inner shaft 30 that connects to a hollow bulb 40. In the preferred embodiment, the shaft 30 runs through the bulb 40 and a cotter pin 32 or other connector, such as a screw and nut fastener system, is used at the top and bottom of the bulb 40 to hold the bulb 40 in place at the end of shaft 30.

The handle 20 is located along the shaft 30 for better control of the brush 10. The handle 20 may be any convenient size and shape, and is preferably manufactured from rubber, plastic or any other suitable material which is comfortable and convenient to hold, can be easily cleaned, and is relatively non-absorbent.

The shaft 30 is preferably a hexagonal rod that is adapted to be received by a standard drill. However, the precise size and shape of the shaft 30 are not to be considered as limitations of this invention. The shaft 30 is typically manufactured from metal or hard plastic that resists rusting, or any other suitable material that will not bend or break as the brush is rotating in a bucket.

FIG. 2 shows an enlarged view of the hollow bulb 40 carried at the end of the shaft 30 of the rotatable scrub brush 10. By way of example only, the bulb 40 is a cylinder that is approximately five inches in diameter and approximately ten inches high. However, the dimensions of the cylindrical bulb 40 can vary according to the needs of the user and the intended use of the scrub brush 10.

The bulb 40 contains bristles 42 that project outwardly from the bottom, sides, and corners such that the bottom, sides and corners or a bucket or similar container (designated 60 in FIG. 4) may be easily accessed and efficiently cleaned. The bulb 40 is preferably manufactured from metal, such as aluminum, but may also be manufactured from any other suitable material (i.e., metal or plastic) such that the bulb 40 is relatively lightweight, non-absorbent, and resists corrosion. The bristles 42 are preferably made of hard nylon or other relatively stiff material adapted to scrub residue (designated 80 in FIG. 4) from a bucket without breaking. The bristles 42 are preferably about 0.5 inches long, but their size can vary according to the needs of the user and the intended use of the scrub brush 10. Thus, it is to be understood that the number and precise location of the bristles 42 should not be considered as limitations of the invention.

Figure 3:
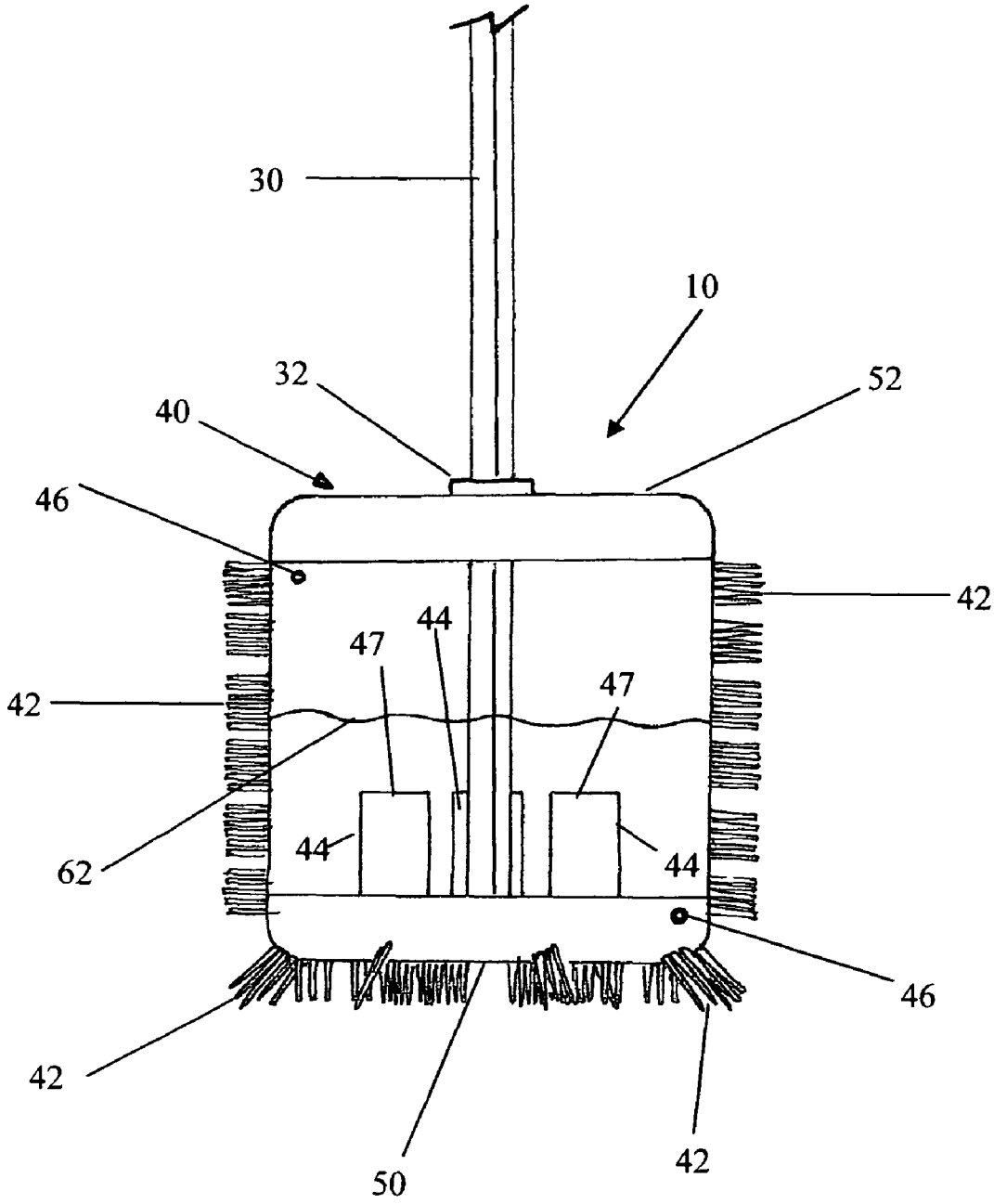
FIG. 3 shows the hollow bulb of FIG. 2 at rest with water collected at the interior thereof.
Figure 5:
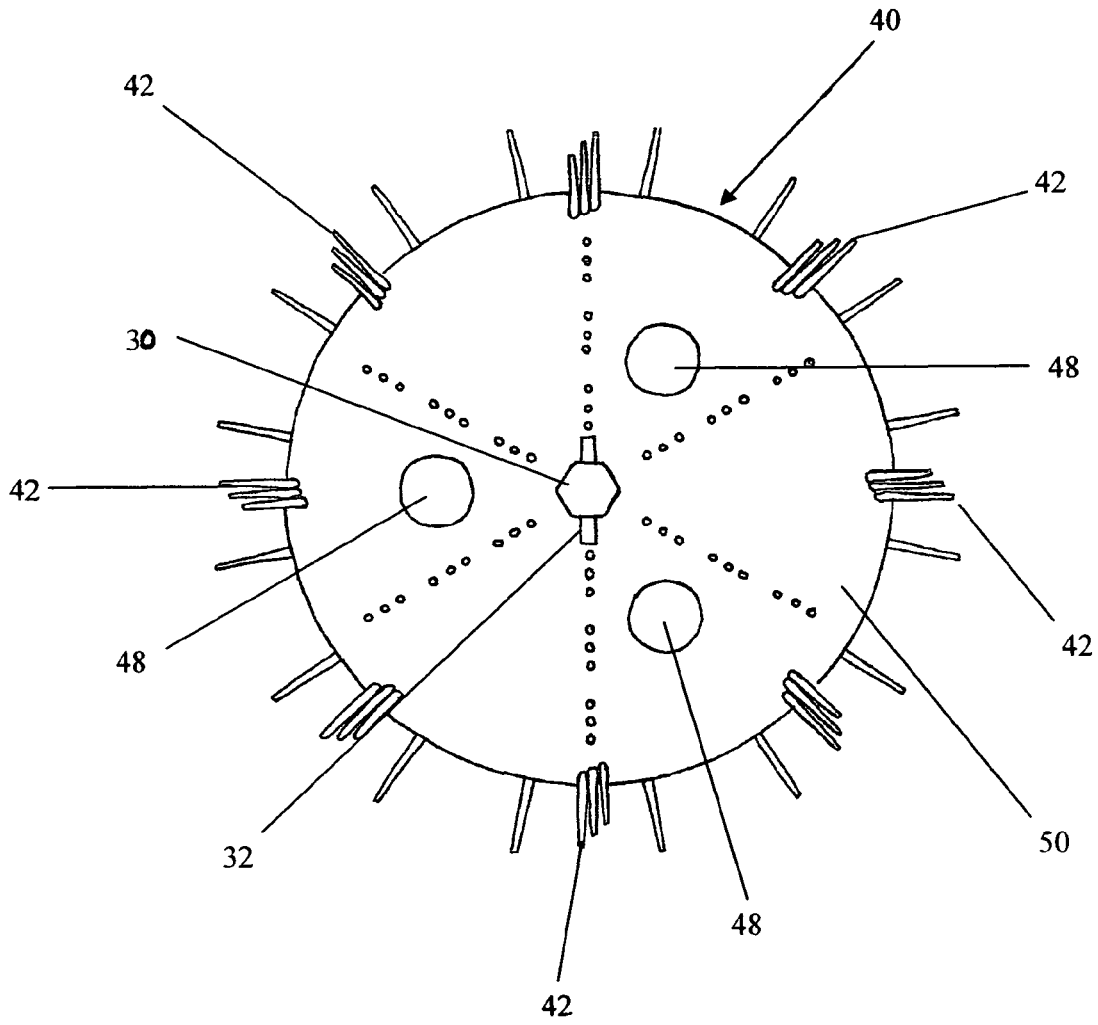
FIG. 5 is a bottom view of the hollow bulb shown in FIG. 2.

In FIG. 3, the scrub brush 10 is shown with the hollow bulb 40 at one end of shaft 30 after the bulb has been dipped in water standing in a bucket. In the preferred embodiment, the hollow bulb 40 contains three water inlet ducts 44 that are cylindrically shaped and open-ended. As best shown in FIGS. 3 and 5, the open bottom 48 of each inlet duct 44 extends through the bottom 50 of the bulb 40, and the open top 47 of each inlet duct 44 extends to a location between the top 52 and bottom 50 of the bulb 40, as will be described in greater detail hereinafter. The water inlet ducts 44 allow water that is standing in a bucket prior to cleaning to enter the hollow bulb 40 through the bottom 50 when the scrub brush 10 is partially submerged. In this case, the water in the bucket enters the open bottoms 48 (of FIG. 5), travels up the water inlet ducts 44, and exits through the open tops 47 thereof. The water then collects inside the hollow bulb 40 at the same level 62 as the water standing inside the bucket 60 (best shown in FIG. 3). The number of water inlet ducts 44 may be more or less than three depending on the volume of the hollow bulb 40 and the diameter of the inlet ducts 44 so long as the user will be able to dip the scrub brush 10 into the water standing in the bucket, whereby the standing water will enter the hollow bulb 40 from the bottom 50 of bulb 40 via the open bottoms 48 of water inlet ducts 44.

Figure 4:
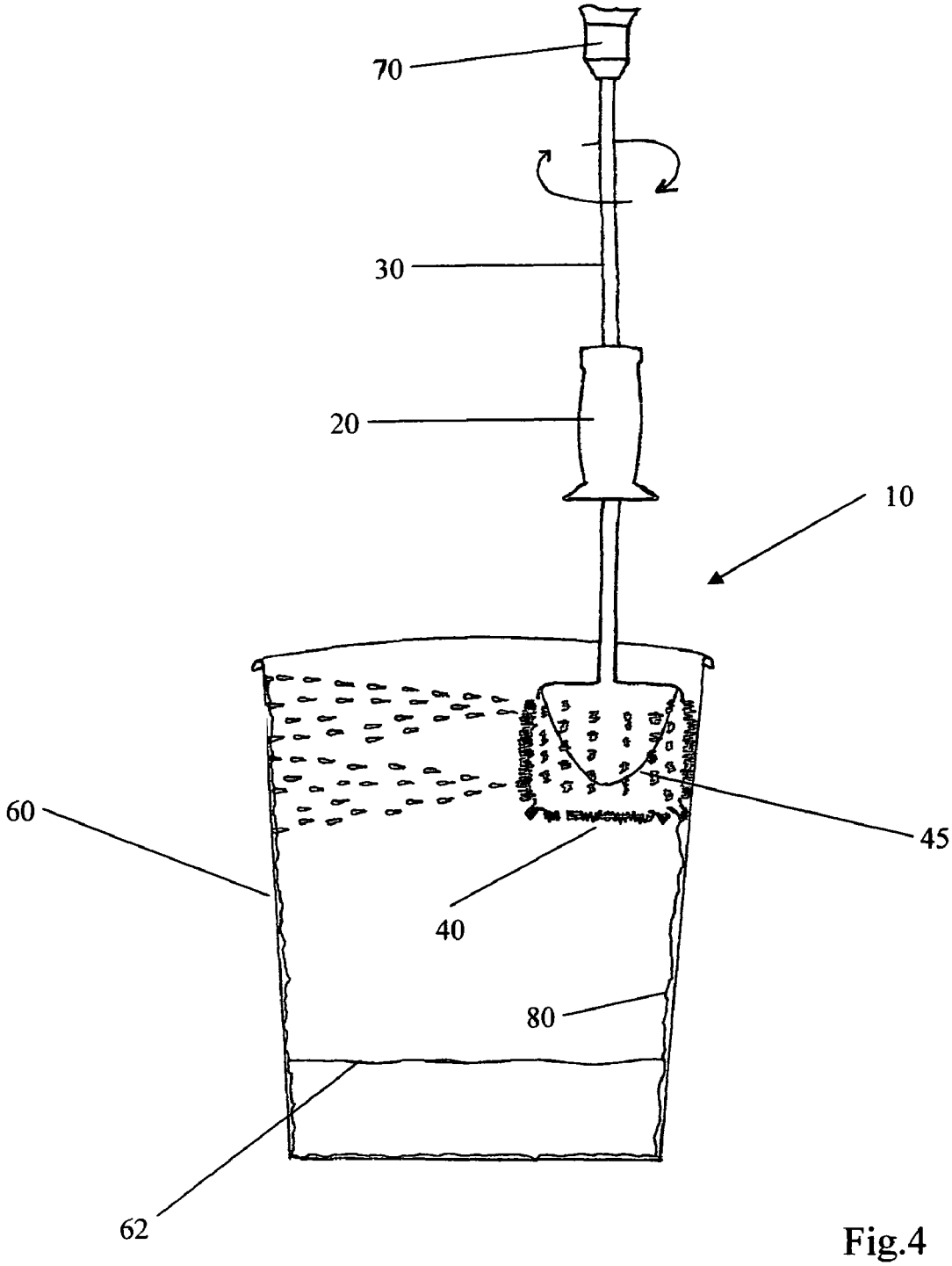
FIG. 4 shows the bulb of the scrub brush spinning inside a bucket for cleaning the sides of the bucket.

A series of water outlet ports 46 are located at various positions through the sides and corners of the bulb 40 of scrub brush 10. The water outlet ports 46 allow water that has collected at the interior of the hollow bulb 40 to be forced outwardly from the bulb 40 as the scrub brush 10 is rotated in order to moisten the bristles 42 and thereby aid the bristles 42 in eroding the residue (80 in FIG. 4) lining the walls of the bucket 60. FIG. 4 also shows the water level 62 in the bucket 60 when the scrub brush 10 is spinning rapidly after being lifted above the water.

The water outlet ports 46 are preferably holes through the bulb 40 that communicate with the hollow interior thereof. The size, number, and location of water outlet ports 46 are not meant to be considered as limitations of this invention and are determined according to the intended use of the scrub brush 10. In the preferred embodiment, a total of eight water outlet ports 46 are evenly spaced around the sides of the bulb 40, with four ports being closer to the top of the bulb 40 and four ports being closer to the bottom of the bulb 40. Some of the water outlet ports 46 are located at the corners of the bulb 40. When the bulb 40 is lifted above the water 62 standing in the bucket 60 (of FIG. 4), water collected in the bulb 40 will escape, under the influence of gravity, through any water outlet ports 46 that are located lower than the level of the collected water in the bulb 40. When the scrub brush 10 is spinning while located above the standing water 62 within the bucket 60 of FIG. 4, the water collected in the bulb 40 will also be expelled through the water outlet ports 46 that are located higher than the level of the water collected in the bulb 40. It may be necessary that the bulb 40 be dipped from time to time in the standing water 62 during cleaning in order to replenish the water collected therewithin.

By way of example only, the inlet ducts 44 are approximately 0.5 inches in diameter. The height of the inlet ducts 44 is a function of the height of the bulb 40. The centrifugal force generated as the bulb 40 of the scrub brush 10 is rotated at high speed by means of the drill 70 causes the water collected in the bulb to be expelled under pressure through the water outlet ports 46 around the bulb 40.

FIG. 4 shows the scrub brush 10 lifted out of the water 62 and moving along the side of a bucket 60 to be cleaned. In this case, the user holds the drill 70 in one hand and grasps the handle 30 around the rotating shaft 30 with the other hand so that the bulb 40 can be urged against the residue 80 to be cleaned from the sides of the bucket 60. The water 45 collected within the spinning bulb 40 rides up the walls of the bulb to be forced out through the water outlet ports 46.

FIG. 5 shows the bottom 50 of the hollow bulb 40, where standing water 62 in the bucket 60 (of FIG. 4) enters the bulb 40 through the open bottoms 48 of the water inlet ducts 44 (best shown in FIG. 3) when the bulb 40 is dipped in the standing water 62 prior to or during cleaning the bucket 60.

Figure 6:
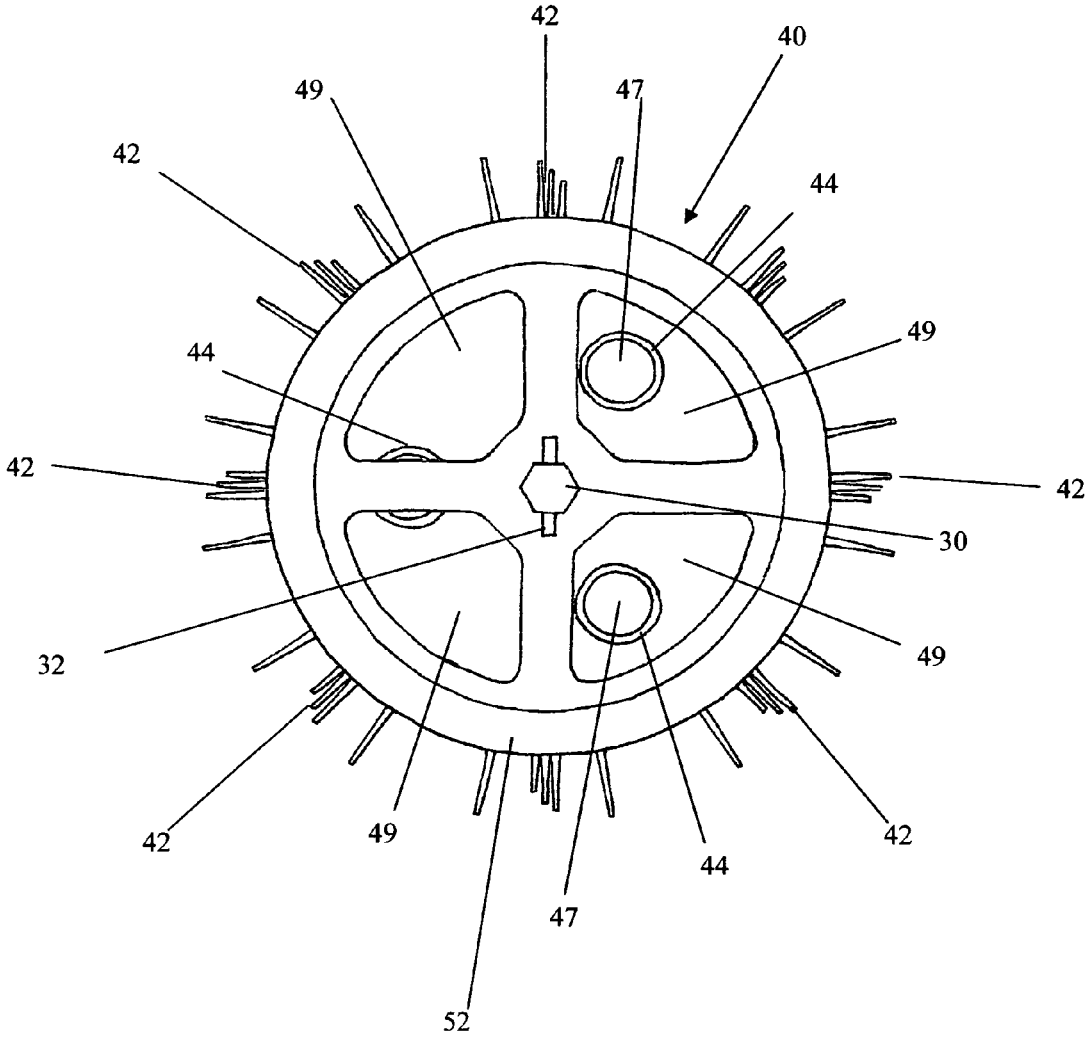
FIG. 6 is a top view of the hollow bulb shown in FIG. 2.

FIG. 6 shows the top 52 of the hollow bulb 40 through which a plurality of (e.g., four) water entrance openings 49 are formed. The water entrance openings 49 allow water to enter from the top 52 of the hollow bulb 40 for collection at the interior of the bulb 40 if the bulb 40 is submerged and the level of the water 62 standing in the bucket 60 of FIG. 4 is higher than the top 52 of the bulb 40. Any water which initially fills the interior of bulb 50 and lies above the water inlet ducts 44 of FIG. 4 will drain from the bottom 50 of the bulb 40 via ducts 44.

The invention claimed is:

1. A brush for removing debris from a surface of a container containing water, said brush comprising:

a shaft to which a rotational force is applied; and a hollow bulb carried by said shaft to be positioned within the water of the container, said hollow bulb having a top, a bottom, and bristles projecting outwardly therefrom, a water inlet comprising at least one opening formed through said bottom through which some of the water from the container is supplied to be collected within said bulb when the water inlet is submerged within the water, said water inlet also comprising a water inlet duct communicating with said one opening through the bottom of said bulb and extending inwardly of said bulb to a location below said top thereof, and a water outlet through which the water collected by said bulb escapes under the influence of gravity and returns to the container when the bulb is lifted out of the water and the water collected by the bulb lies above said water outlet, said shaft imparting the rotational force to said hollow bulb when said bulb is lifted out of the water to cause said bulb to spin and the water collected within said bulb to be ejected through said water outlet and returned to the container while moistening said bristles and causing the debris to be removed from the container surface, such that some of the water escaping and being ejected from the hollow bulb and returning to the container is once again collected within said bulb by way of the water inlet when said bulb stops spinning and is lowered back into the water of the container so that said water inlet is submerged therewithin, whereby the water from the container is recycled between said hollow bulb and the container.

2. The brush recited in claim 1, wherein said water inlet further comprising at least one opening formed through said top.

3. The brush recited in claim 1, wherein said water outlet comprises at least one hole formed through said hollow bulb and communicating with the interior thereof.

4. The brush recited in claim 3, wherein said hollow bulb has a cylindrical side wall extending between said top and said bottom, said water outlet comprising a plurality of holes formed through said cylindrical side wall and communicating with the interior of said bulb, at least one of said plurality of holes being located adjacent said top, and at least one other of said plurality of holes located adjacent said bottom.

5. The brush recited in claim 4, wherein some of said bristles are located at a top corner of said hollow bulb at the intersection of the cylindrical side wall thereof with said top, and some other bristles are located at a bottom corner of said bulb at the intersection of said cylindrical side wall with said bottom.

6. The brush recited in claim 1, further comprising a handle surrounding said shaft, said handle adapted to be grasped and held in the hand of a user, such that said shaft rotates with respect to said handle.

7. A brush for removing debris from a surface of a container containing water, said brush comprising:

a shaft to which a rotational force is to be applied; and a hollow bulb carried by said shaft to be positioned within the water of the container, said hollow bulb having a top wall, a bottom wall and a sidewall extending between the top and bottom walls, bristles projecting outwardly from said bulb, a water inlet through the bottom wall of said bulb through which some of the water from the container is supplied to be collected within said bulb when the water inlet through said bottom wall is submerged and said bulb is not being rotated by said shaft, a water inlet through the top wall of said bulb, and a water outlet, said shaft imparting a rotational force to said hollow bulb when said bulb is lifted out of the water to cause said bulb to spin and the water collected within said bulb to be ejected through said water outlet and returned to the container while moistening said bristles for enabling the debris to be removed from the container surface when the bristles are moved along the container surface, such that some of the water being ejected from the hollow bulb through said water outlet and returning to the container is collected within said bulb while said bulb is still spinning by way of the water inlet through the top wall of said bulb when said spinning bulb is lowered into the water of the container so that the water inlet through said top wall is submerged, whereby the water from the container is recycled between the container and said spinning bulb by way of the water inlet through the top wall of said bulb.

8. The brush recited in claim 7, wherein the water inlet through the bottom wall of said bulb includes a water inlet duct extending from the bottom wall of said bulb to a location below said top wall thereof.

9. The brush recited in claim 7, wherein said water outlet comprises at least one hole formed through said hollow bulb and communicating with the interior thereof.

10. The brush recited in claim 7, said water outlet comprising a plurality of holes formed through said side wall and communicating with the interior of said bulb, at least one of said plurality of holes being located adjacent said top wall, and at least one other of said plurality of holes being located adjacent said bottom wall.

11. The brush recited in claim 7, wherein some of said bristles are located at a top corner of said hollow bulb at the intersection of the side wall thereof with said top wall, and some other bristles are located at a bottom corner of said bulb at the intersection of said side wall with said bottom wall.

12. The brush recited in claim 7, further comprising a handle surrounding said shaft, said handle adapted to be grasped and held in the hand of a user, such that said shaft rotates with respect to said handle.

13. The brush recited in claim 7, wherein the water inlet through the bottom wall of said bulb through which water is collected by said bulb when said bottom water inlet is submerged and said bulb is not being rotated includes at least one hole formed through said bottom wall, and the water inlet through the top of said bulb through which recycled water is collected by said bulb when said top water inlet is submerged and said bulb is spinning includes at least one hole formed through said top wall, such that all of the water collected by said bulb is supplied thereto from the container by way of the water inlet hole formed through said bottom wall and the water inlet hole formed through said top wall.

14. A method for using a brush for removing debris from the sides of a container containing water comprising the step of providing the brush of claim 7, said method further comprising the steps of:

lowering the hollow bulb of said brush into the water of the container when no rotational force is applied to the shaft and said bulb is not spinning such that the first water inlet through said bottom wall is submerged and the hollow bulb receives water from the container through said water inlet;

lifting said hollow bulb out of the water and applying a rotational force to the shaft of said brush for causing said hollow bulb to spin while said bulb is moved along a side of the container such that some of the water received by the bulb escapes therefrom by way of said water outlet so as to moisten the bristles of the bulb and return to the container; and lowering said hollow bulb back into the water while said bulb is still spinning such that the water inlet through said top wall is submerged, whereby water is recycled from the container to said spinning bulb by way of the water inlet through said top wall.

* * * * *